United States Patent [19]

Hartig

[11] 3,971,201

[45] July 27, 1976

[54] FALSE-TWIST CRIMPING MACHINE

[75] Inventor: Wolfgang Hartig, Remscheid, Germany

[73] Assignee: Barmag Barmer Maschinenfabrik Aktiengesellschaft, Wuppertal, Germany

[22] Filed: Aug. 7, 1975

[21] Appl. No.: 602,729

[30] Foreign Application Priority Data

Aug. 16, 1974 Germany ..... 2439183

[52] U.S. Cl. ..... 57/34 HS; 57/106; 57/157 TS

[51] Int. Cl.[2] ..... D02G 1/02

[58] Field of Search ..... 57/34 HS, 55.5, 90, 57/106, 157 R, 157 TS; 28/62

[56] References Cited

UNITED STATES PATENTS

| | | | |
|---|---|---|---|
| 2,918,778 | 12/1959 | Wormser | 57/34 HS |
| 3,041,813 | 7/1962 | Enneking | 57/34 HS |
| 3,541,775 | 11/1970 | Fisher, Jr. | 57/157 TS |
| 3,559,255 | 2/1971 | Cockroft | 57/34 HS X |
| 3,636,697 | 1/1972 | Trepton et al. | 57/106 |
| 3,724,191 | 4/1973 | Hooper et al. | 57/34 HS |
| 3,729,916 | 5/1973 | Lusk et al. | 57/34 HS |
| 3,747,227 | 7/1973 | Zang et al. | 57/106 X |
| 3,842,578 | 10/1974 | Schippers | 57/34 HS |

*Primary Examiner*—John Petrakes
*Attorney, Agent, or Firm*—Johnston, Keil, Thompson & Shurtleff

[57] ABSTRACT

A false twist crimping apparatus having an elongated contact heater with pivotable yarn guides in operating positions at either end of the heater, one yarn guide being shiftable lengthwise of the heater on a carrier means, said apparatus also including a pivotable rocker cam engaging the shiftable yarn guide when in its operating position for the transfer of pivot movements from the cam to the guide and linking means to connect the rocker cam with the other yarn guide to synchronize the pivot movements of the cam and both yarn guides, thereby applying the yarn onto or removing the yarn from the contact heater.

6 Claims, 2 Drawing Figures

FALSE-TWIST CRIMPING MACHINE

Figure 1:
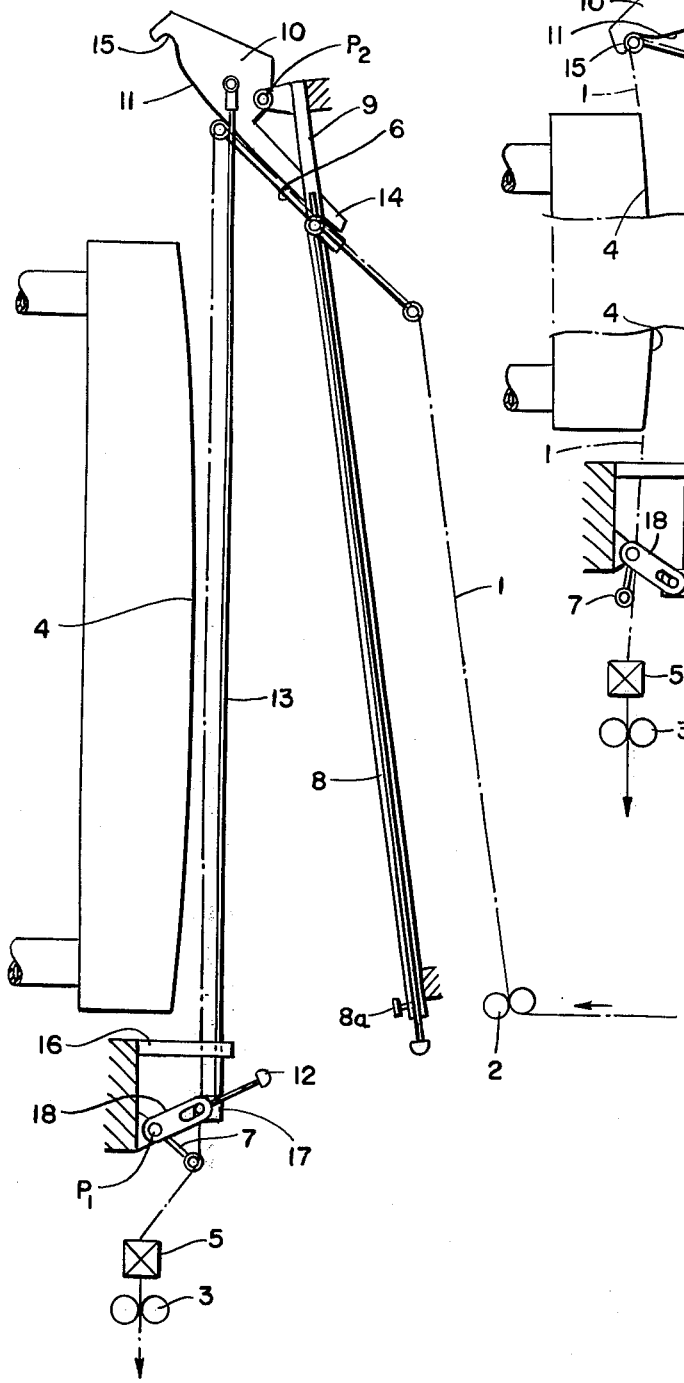

False twist crimping apparatus is generally known for the purpose of texturizing synthetic thermoplastic continuous filaments in the form of a yarn, thread or similar filamentary bundle, especially with polyester and nylon fiber-forming polymer filaments which may be rapidly melt-spun and stretched or drawn into a multifilament yarn and then texturized. The false twist crimping procedure essentially produces a so-called "torque-crimp" in the yarn, and when the false twist of the yarn is heat-set by a heat treatment of the yarn, the product is often referred to as a "durable torque-crimp texturized yarn." For a detailed discussion of the false twisting process and earlier patents in this art, attention is directed to "Woven Stretch and Textured Fabrics," B. L. Hathorne, Interscience Publishers, Division of John Willy & Sons, New York (1964), especially Chapters 2 and 3, pages 19–77. The present invention is of course also applicable to later spin-draw and texturizing processes, especially those developed to accommodate high speed spinning and drawings (stretching) procedures.

In order to reduce space requirements in the installation of false twist crimping apparatus, it has been a practice to provide a contact heating device, e.g., a slightly curved heating plate, located substantially vertically and at least partly above the height and out of the reach of operating personnel. See for example the German Gebrauchsmuster Patent (DT-Gbm) No. 1,958,183.

In order to thread such apparatus, i.e., apply the yarn to the contact heater, one may provide an upper thread or yarn guide which is shiftable or transportable up to the top of the heater by means of an adjustable carrier device. The yarn or thread running from a creel, feed bobbin or other supply means is thus carried overhead onto the heating device.

A preferred false twist crimping apparatus is one which has been successful for the simultaneous stretching and false twist crimping of the multifilament yarn. The technique used for threading the yarn, which runs at a predetermined speed in this apparatus, is quite critical. Thus, it has been recommended that stretching be initiated while conducting the still unstretched yarn during the threading operation at first only through the radiation and convection zone longitudinally of the heating plate and free of direct contact with this plate, e.g., approximately parallel to the plate. Then, after the stretching has been initiated, the path of the running yarn is shifted to directly contact the heated surface of the plate as required during normal operation. This shifting can be accomplished through a displacement of upper and lower yarn guides, after the stretching is initiated, in such a manner that the yarn length between the nip points or hold points of the feed apparatus and draw-off apparatus remains substantially constant. For a preferred technique of this kind, see German published application (DT-OS) No. 2,155,514, corresponding to U.S. Pat. No. 3,842,578. The subject matter of this U.S. Patent is incorporated herein by reference as fully as if set forth in its entirety.

The present invention is essentially directed to an improvement in the apparatus as generally disclosed in U.S. Pat. No. 3,842,578 so as to better accomplish the specific threading and start-up procedure or technique as taught in this patent. It is especially an object of the present invention to provide a means of synchronizing the movements of the upper and lower yarn guides used to bring the running and stretched yarn into direct contact with an elongated heating plate or a similar contact heater while maintaining the length of the yarn constant between the feed means and the draw-off means or else providing an exactly determined difference of yarn length as between the open position of the two guides and their normal operating or closed position.

These objects are achieved in a false twist crimping apparatus having means to continuously stretch a thermoplastic yarn between yarn supply means and yarn draw-off means together with an elongated contact heater, preferably a slightly curved heating plate, and a false-twisting device to simultaneously torque-crimp and heat-set the stretched yarn, by providing in accordance with the invention, i.e., in combination with said apparatus: a lower yarn guide arranged pivotably on a horizontally fixed axis relative to an approximately vertically positioned contact heater; an upper yarn guide slidable longitudinally of the contact heater on a carrier means and mounted pivotably on a second horizontal axis relative to said contact heater; a rocker cam mounted pivotably on a fixed horizontal axis adjacent said upper yarn guide in its upper operating position, said rocker cam having a curved surface for positive contact with said upper yarn guide to transfer the pivot movement of the rocker cam to pivot the upper yarn guide in applying yarn onto said heater or removing said yarn therefrom: and linking means connecting the rocker cam and lower yarn guide to synchronize their pivot movements.

Figure 2:
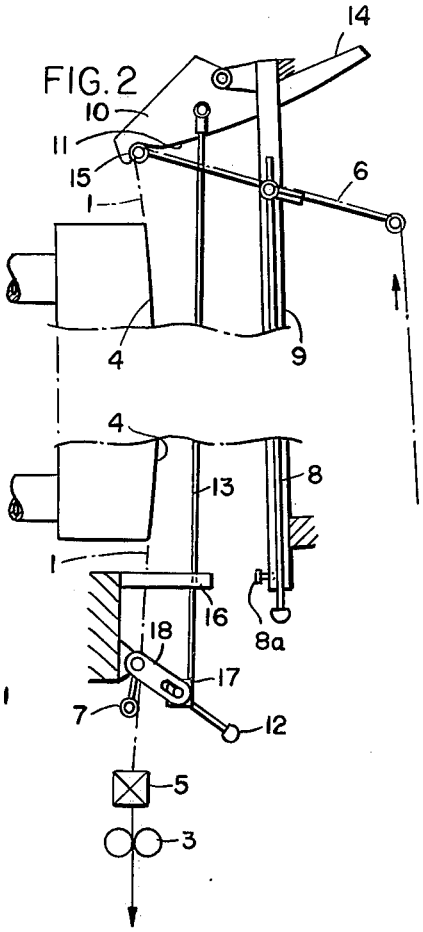

The resulting improvement in a combined false twist crimping and stretching apparatus is illustrated and described in detail as follows, taken in conjunction with the accompanying drawing in which:

FIG. 1 is a partly schematic side elevational view of the essential apparatus for simultaneously stretching, false twist crimping and heat-setting the yarn between a pair of feed rolls and a pair of draw-off rolls, including the synchronized threading means required by the invention; and FIG. 2 is a partial reproduction of the view given in FIG. 1, the feed rolls and the central portion of the apparatus being omitted, illustrating the closed or normal operating position of the threading means in comparison to the open position shown in FIG. 1.

The drawings shows the running yarn 1 in the combined false twist and stretching zone which extends between the feed means 2 provided by one pair of nip rolls and the draw-off means 3 provided by another pair of nip rolls. The velocity of these feed rolls and draw-off rolls are adjusted so that the yarn is stretched. The yarn should be heated between the feed means and the draw-off means by direct contact with the heating device 4, and should be false twisted by the false twister 5, i.e., a false twist twisting spindle or the like, such that the false twisted yarn extends back over the curved surface of the heater 4 when normally operated as in FIG. 2.

The yarn is conducted over the upper yarn guide 6 and the lower yarn guide 7. Both are pivotable about a horizontal axis relative to the generally vertical position of the curved heating plate 4. It will be understood that such "vertical" and "horizontal" positions are given here as an aid to the definition of the spatial relationship of the various parts of the apparatus and that it is not essential to place the heater in a vertical position. The pivot axis of the upper yarn guide 6 is located on the carrier device 8 which is shiftable longitudinally of the heating plate 4, e.g. as in U.S. Pat. No. 3,842,578, so that the yarn guide 6 can be lowered within reach of the operating personnel. In the illustrated upper position, i.e. the open or closed operating position of yarn guide 6, the carrier device 8 is locked or secured in position, for example by a set screw 8*a* or other locking means at its lower handle end.

In close proximity to the guide 6 in its upper operating position, there is located the rocker cam 10 with a curved cam surface 11, the rocker cam also being pivotable on a fixed horizontal axis relative to a vertical heater. The lower yarn guide 7 is pivoted by means of the handle 12. The handle 12 is connected with the rocker cam 10 by a rod 13 as a direct mechanical linking means between the rocker and the lower yarn guide.

One special advantage of the apparatus of the invention resides in the fact that the pivot movements of the lower and upper yarn guides take place synchronously or cooperatively in a predetermined pattern even though the upper yarn guide is movable with the carrier device and the lower yarn guide is fixed in place. Furthermore, it is possible to form and arrange the cam surface 11 of the rocker cam 10 for cooperation with the lower yarn guide 7 such that absolutely no change or else an exactly defined positive or negative change of the yarn length is produced between the nip points of the feed rolls 2 and draw-off rolls 3 of the stretching and false twisting zone. This yarn length may be designated as "$Y_L$" for purposes of further discussion.

The swinging or pivoting movement of the upper yarn guide 6 in itself does not produce any extensive difference in the yarn length $Y_L$, provided that the feed rolls 2 and nip rolls 3 (together with any additional yarn guides located between these rolls and the upper guide 6) are arranged in a symmetrical manner with reference to guide 6. Minor compensating adjustments can be easily made if there is a non-symmetrical arrangement in the placement of these rolls and/or associated yarn guides.

In moving the yarn 1 from the open operating position shown in FIG. 1 to the closed or normal operating position shown in FIG. 2, the yarn length is necessarily increased by the deflecting bow or curve of the heater surface 4 which prevents the yarn from being transported in a straight line to the false twister 5. Nevertheless, a curved heater surface is desirable in order to maintain good contact between the heater and the running yarn, and this curved surface may also be in the form of grooves or channels for each yarn being treated.

In order to compensate for this unavoidable increase in the yarn length $Y_L$ (and any other increase due to the overall geometry of the system), the lower yarn guide 7 is initially positioned about the pivot axis $P_1$ to deflect the yarn away from the heater surface 4 in another non-linear path, depending upon the initial placement of this lower guide. One can easily vary this initial position of the lower guide 7 independently of the upper guide 6 by providing a guide arm of adjustable length, by providing a connecting rod 13 of adjustable length and/or by movement of the handle 12 to pivot the guide 7 downwardly so as to reduce the amount of deflection while also curving the cam surface 11 sufficiently to maintain an approximately constant radius of curvature between surface 11 and pivot axis $P_2$ over the initial downward positioning of the guide 7. The connecting or linking rod 13 can be guided in the support bar 16 and connected adjustably to the outer end of the pivot block 17 carried by a pin in a slotted arm 18 of the lower yarn guide 7. These and similar variations can be readily incorporated into the specific apparatus of the invention to make certain that the yarn length $Y_L$ remains constant as it is applied from the open to the closed operating position or else that this length $Y_L$ is changed according to a predetermined pattern and/or in a predetermined amount.

In order to keep $Y_L$ absolutely constant, the cam surface 11 contacting and positively directing the upper guide 6 should be designed so that the running yarn just begins to contact the heater surface 4 as the lower guide 7 reaches a point in its pivot movement at which the amount of yarn deflection caused by this lower guide is being reduced from its initial value or point of maximum deflection. Then, as the heater surface takes up the yarn, the lower guide 7 causes less and less deflection and may even be completely withdrawn from contact with the yarn as suggested in FIG. 2 where the yarn runs directly from the heater surface 4 to the false twister 5.

At the normal operating position, the upper yarn guide 6 can be captured by a notch 15 or other locking means to releasably secure the yarn guides in this closed position. In general, the individual yarn guide elements such as freely rotatable rollers or pulleys are mounted on the arms of the upper and lower guides 6 and 7 together with a second roller of large diameter (as indicated by the two concentric circles) so that this second roller may act both as a lateral guide means and/or as the cam follower means where this second roller contacts the cam surface 11.

In order to thread the yarn into the apparatus, one can generally follow the same instructions given in the above-noted U.S. Pat. No. 3,842,578. Thus, the carrier device or extension rod 8 is first brought to its lower position, i.e. its service position within the reach of operating personnel. In this position, the yarn can be applied onto the yarn guides 6 and 7 as well as the false twister 5. Then, the carrier 8 is moved into its upper operating position and secured in this position. Thereupon, the yarn is nipped or engaged into the feed rolls 2 and the draw-off rolls 3 so that yarn stretching is initiated. The tail 14 of the rocker cam 10 during this initiation of the stretching prevents a tilting of the yarn guide 6. As soon as a sufficiently long piece of yarn is stretched, i.e. so as to reach steady conditions in the open operating position of FIG. 1, the handle 12 is gradually pivoted downwardly whereby the lower yarn guide 7 is moved on a circular path toward the heating plate 4 while the upper yarn guide 6 slides along the cam surface 11 according to a predetermined path of movement.

It is also desirable to vary the running speed of the yarn to further accommodate the changing stretching and false twisting conditions as the yarn is moved from the convection and radiation heating zone of the open operating position to the direct contact heating zone of the closed or normal operating position. Again reference is made to the instructions provided in U.S. Pat. No. 3,842,578.

The apparatus of the present invention, especially with reference to the preferred embodiments illustrated herein, is also advantageous in being relatively simply constructed and economical in their installation and maintenance. Moreover, while this apparatus is especially useful in processing polyester yarns (polyethylene terephthalate filaments), the individual elements are readily replaceable and adaptable to a wide variety of yarn types and sizes. The essential moving parts required to thread the apparatus and to place it in operation are relatively small and lightweight so that space requirements are minimal and the operator can easily carry out the required manipulative steps. The apparatus is therefore quite economical both in its construction and its operation.

The invention is hereby claimed as follows:

1. In a false twist crimping apparatus having means to continuously stretch a thermoplastic yarn between yarn supply means and yarn draw-off means together with an elongated contact heater and a false-twisting device to simultaneously torque-crimp and heat-set the stretched yarn, the improvement which comprises:

a lower yarn guide arranged pivotably on a horizontally fixed axis relative to an approximately vertically positioned contact heater;

an upper yarn guide slidable longitudinally of the contact heater on a carrier means and mounted pivotably on a second horizontal axis relative to said contact heater;

a rocker cam mounted pivotably on a fixed horizontal axis adjacent said upper yarn guide in its upper operating position, said rocker cam having a curved surface for positive contact with said upper yarn guide to transfer the pivot movement of the rocker cam to pivot the upper yarn guide in applying yarn onto said heater or removing said yarn therefrom; and linking means connecting the rocker cam and lower yarn guide to synchronize their pivot movements.

2. Apparatus as claimed in claim 1 wherein said rocker cam has a tail member extending along the upper yarn guide to prevent a tilting pivotal movement of this guide during initiation of the stretching of the yarn.

3. Apparatus as claimed in claim 1 including an extensible carrier means to position the upper yarn guide in an upper operating position after being threaded in a lower position.

4. Apparatus as claimed in claim 1 wherein said linking means is a rod connected pivotally at one end to said rocker cam and at the other end to the lower yarn guide.

5. Apparatus as claimed in claim 4 wherein said lower yarn guide has two divergent arms extending from its fixed pivot point, one arm being provided with a handle means and the other arm carrying a yarn guiding roller or pulley.

6. Apparatus as claimed in claim 5 wherein one of the guide arms is slotted to receive a pin attached to a pivot block which in turn is connected to said rod linking means.

* * * * *